United States Patent [19]

Helms

[11] 4,209,125

[45] Jun. 24, 1980

[54] PARTITION STRUCTURE FOR SEPARATING GROUPED ARTICLES SUCH AS CONTAINERS

[75] Inventor: Charles R. Helms, Collegeville, Pa.

[73] Assignee: Container Corporation of America, Chicago, Ill.

[21] Appl. No.: 12,358

[22] Filed: Feb. 15, 1979

[51] Int. Cl.[2] ..... B65D 5/48; B65D 71/00; B65D 25/04

[52] U.S. Cl. ..... 229/15; 229/42

[58] Field of Search ..... 229/15, 42, 28 BC

[56] References Cited

U.S. PATENT DOCUMENTS

| | | | |
|---|---|---|---|
| 3,166,228 | 1/1965 | Weiss | 229/15 |
| 3,352,473 | 11/1967 | Graser | 229/15 |
| 3,478,947 | 11/1969 | Schillinger | 229/15 |
| 3,662,879 | 5/1972 | Helms | 229/15 |
| 3,743,163 | 7/1973 | Helms | 229/15 |
| 3,868,055 | 2/1975 | Langen | 229/15 |
| 3,980,223 | 9/1976 | Curran | 229/15 |
| 3,982,684 | 9/1976 | David | 229/15 X |
| 4,120,442 | 10/1978 | Skaggs | 229/15 |
| 4,144,995 | 3/1979 | Travis | 229/42 X |

*Primary Examiner*—Davis T. Moorhead
*Attorney, Agent, or Firm*—Carpenter & Ostis

[57] ABSTRACT

A partition separator for containers sold in the trade generally as multi-packs is disclosed. The separator is formed from a cut and scored blank of paperboard or the like having foldably joined separator elements extending in a vertical plane inclined to a vertical plane extending between rows of said containers and transversely extending separator elements foldably joined to the first named separator elements, the transverse elements extending in a vertical plane between containers of a row.

10 Claims, 19 Drawing Figures

PARTITION STRUCTURE FOR SEPARATING GROUPED ARTICLES SUCH AS CONTAINERS

BACKGROUND OF THE INVENTION

The structure according to the present invention finds particular application in the field of packaging beverages. According to the invention the structure may be employed in packaging a plurality of containers such as six, eight, twelve, etc. bottles in a package.

THE DRAWINGS

Figure 1:
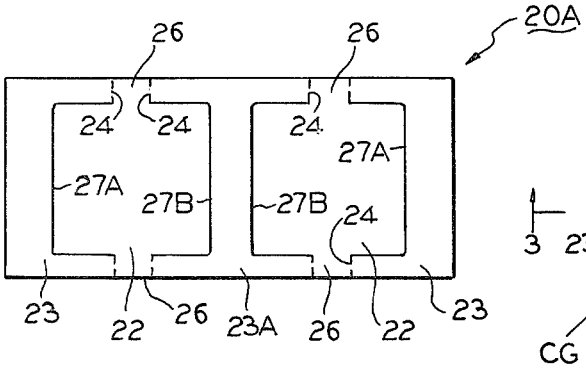
FIG. 1 illustrates a cut and scored blank for forming a partition separator according to one embodiment of the invention.

The improved partition separator according to one embodiment of the invention is denoted by the reference numeral 20 and is formed from a cut and scored blank 20A of paperboard or the like.

Figure 2:
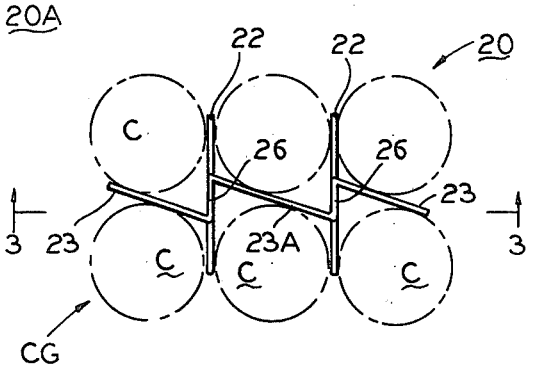
FIG. 2 is a plan view of the erected separator showing it in position for separating the containers of a container group.

Blank 20A is folded and erected to provide separation of individual containers C of a container group CG seen in FIG. 2. A feature of the invention lies in the fact that separation of the rows of the containers is achieved by a separator element 23 lying in a vertical plane inclined to a vertical plane extending between the rows of containers C. Transversely extending separator elements 22 extend between side-by-side containers C within a row thereof and are foldably joined to the element 23 along parallel fold lines 24.

The blank 20A provides distal separator elements 23, defined by cut lines 27A extending between aligned and discontinuous fold lines 24, and a central separator element 23A defined by cut lines 27B extending between other discontinuous aligned fold lines 24. The arrangement is such that upon folding of the blank 20A along the fold lines 24 an erected structure is provided, as best seen in FIGS. 2 and 3.

It should be noted that the transverse separator elements 22 are each provided with upper and lower areas 26 defined by the fold lines 24 to afford connection to the separator elements 23 and 23A.

Figure 3:
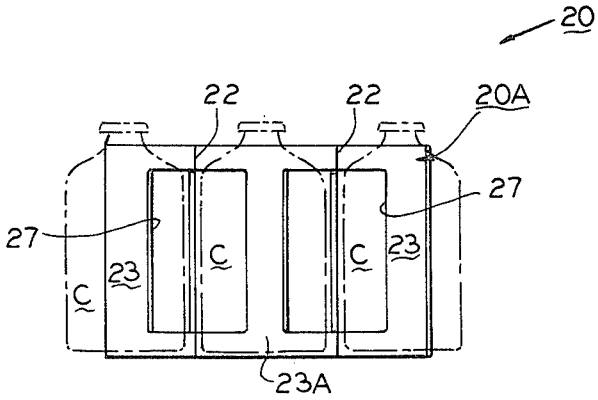
FIG. 3 is a longitudinal elevational view taken generally along the line 3—3 of FIG. 2.

In the embodiment seen in FIGS. 1 to 3, the distal transverse separator elements 23 are generally C-shaped, while the central element 23A is generally I-shaped.

A structure for erecting the blank 20A and causing the containers C and separator 20 to move into position to provide a resultant container group CG forms no part of the present invention.

Figure 4:
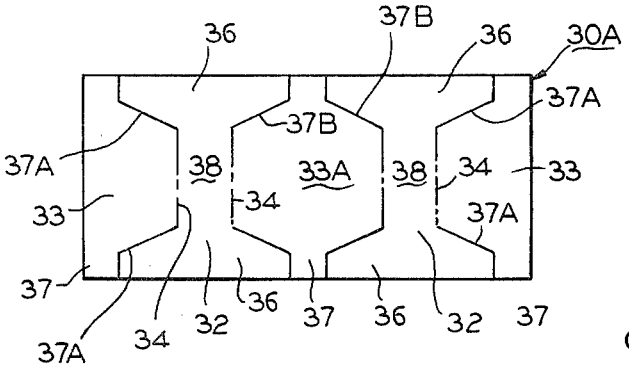
FIG. 4 is a view of a cut and scored blank for forming another embodiment of the present invention.
Figure 5:
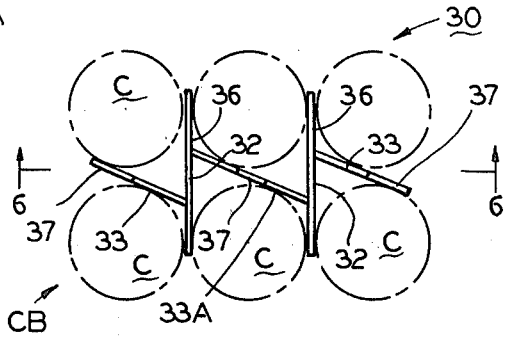
FIG. 5 is a plan view showing the blank of FIG. 4 in its erected form for separating containers of a container group.
Figure 6:
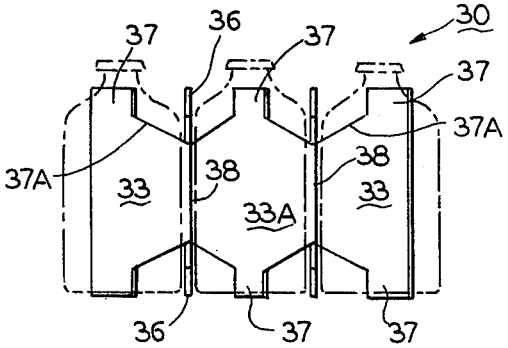
FIG. 6 is a longitudinal elevational view taken generally along the line 6—6 of FIG. 5.

Referring to FIGS. 4 to 6, there is shown another embodiment of the present invention denoted by reference numeral 30 and formed from a cut and scored blank 30A having separator elements 33 and 33A alternating with transverse separator elements 32 foldably connected along fold lines 34. The distal elements 33 are defined with respect to the transverse elements 32 by cut lines 37A extending from aligned fold lines 34. The central element 33A is separated from elements 32 flanking the same by cut lines 37B continuous with the correlative aligned fold lines 34.

The arrangement is such that the distal separator elements 33 are generally of semi-hexagonal configuration while the separator element 33A is hexagonal in form. The separator elements 32 have a substantial I-configuration. The arrangement is such that each transverse element 32 has upper and lower wings 36, while elements 33 and 33A have tabs 37 lying between the wings 36. The wings 36 are connected to a central stem 38 defined by the fold line of transverse elements 32.

Figure 7:
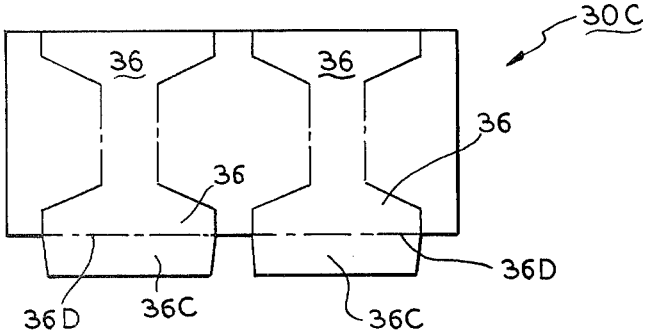
FIG. 7 is a plan view of a cut and scored blank for forming a separator according to another embodiment.
Figure 8:
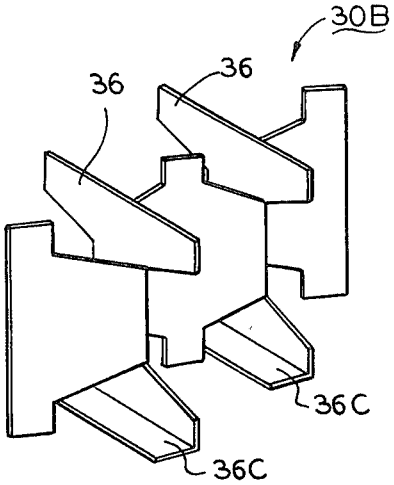
FIG. 8 is an isometric view showing the blank of FIG. 7 formed into a separator.

Referring now to FIGS. 7 and 8, there is shown an embodiment 30B formed from a cut and scored blank 30C. This embodiment differs from that seen in FIGS. 4 to 6 in that each wing 36 is provided with a foot 36C foldably connected thereto along a fold line 36D.

When blank 30C is erected, as seen in FIG. 8, the feet 36C are engaged by the bottoms of the containers C to prevent the partition structure 30B from being dislodged upward from between containers C.

Figure 9:
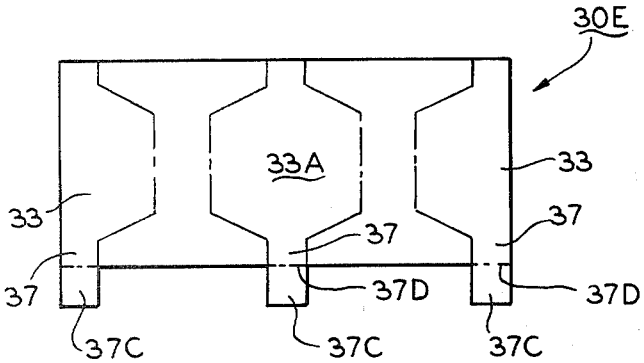
FIG. 9 is a plan view similar to FIG. 7 showing a variant form of a separator.
Figure 10:
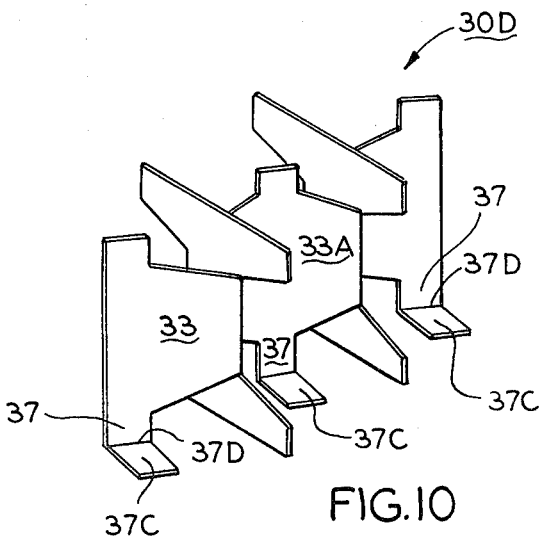
FIG. 10 is an isometric view showing the blank of FIG. 9 formed into a separator.

Referring to FIGS. 9 and 10, there is shown still another embodiment referred to by a reference numeral 30D and formed from a cut and scored blank 30E. In this embodiment, each of the tabs 37 is formed with a foot 37C foldably connected thereto along a fold line 37D.

As with the embodiment of FIG. 8, the partition structure shown in FIG. 10 is prevented from dislodgment upward by contact of the bottoms of the containers C with the feet 37C which are folded to the position seen in FIG. 10.

Figure 11:
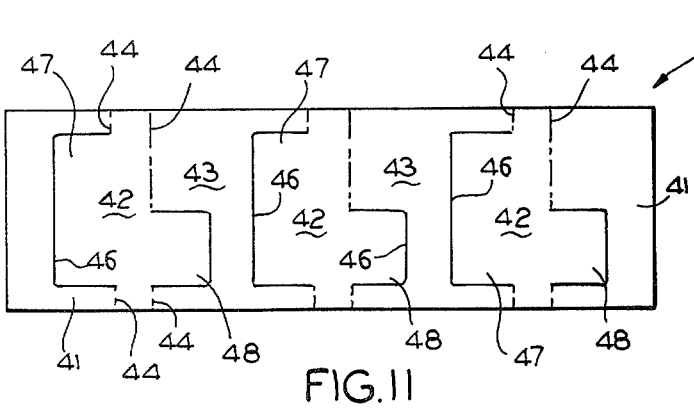
FIG. 11 is a plan view of a cut and scored blank according to still another embodiment, particularly adapted for separation of containers in an eight-pack.
Figure 13:
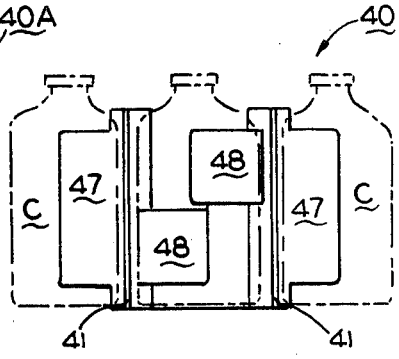
FIG. 13 is an end view of a container group having twelve containers therein and employing a pair of the separators of FIGS. 11 and 12 for separation of the containers of such group.
Figure 12:
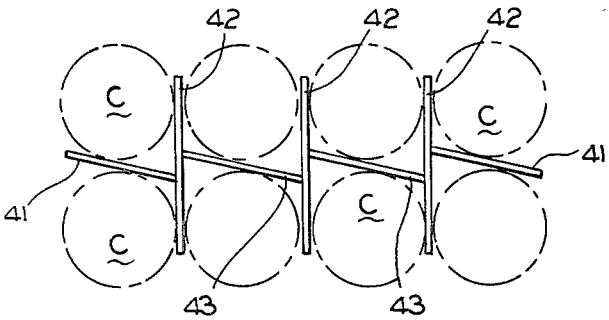
FIG. 12 is a plan view of the erected blank of FIG. 11 in position for separation of a container group having eight containers therein.

Referring now to FIGS. 11 to 13, there is shown an embodiment of a partition separator used with a container group comprised of eight or twelve containers. Irrespective of either number of the containers, the structure is referred to by reference numeral 40 and is formed from a cut and scored blank 40A. The structure has distal separator elements 41 and transverse separator elements 42, the latter being foldably connected to intermediate separator elements 43. The foregoing elements are foldably connected in an alternating fashion along paired fold lines 44. The blank 40A is cut along lines 46 connecting an aligned pair of fold lines 44 to define tabs 47 on one side of the separator elements 42 for separating longer containers while on the other side, the tabs 48 are defined for separation of shorter containers.

The remaining separator elements cut and folded from the blank 40A are inclined in a vertical plane from a vertical plane passing between the rows of containers C. The salient feature of this embodiment lies in the fact that the erected partition formed from the blank 40A can be placed in reversed vertical position with a like structure to afford nesting of the shorter tabs 48 and provide separation of containers of a pack of twelve containers.

In similar fashion, the blank 40A can be adapted for packing of six containers as well as nine containers.

Figure 15:
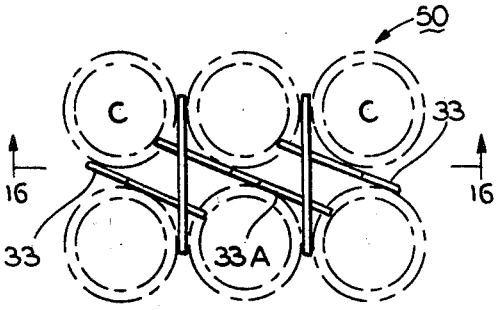
FIG. 15 is a plan view of a container group having the separator structure in position.
Figure 14:
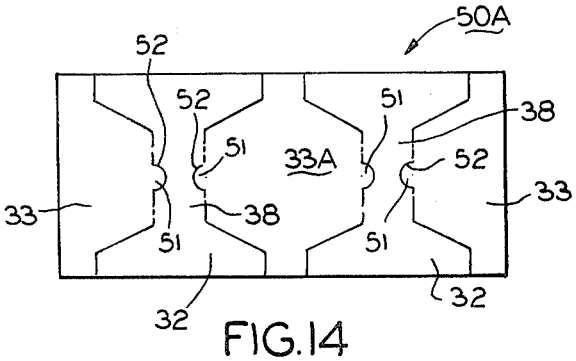
FIG. 14 is a plan view of a cut and scored blank for forming a partition structure according to still another embodiment.
Figure 16:
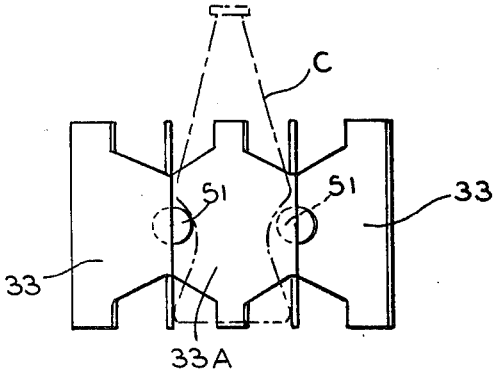
FIG. 16 is a longitudinal elevational view taken generally along the line 16—16 of FIG. 15.

Referring now to FIGS. 14 to 16, there is shown still another embodiment 50 of a partition structure formed from a cut and scored blank 50A. The form according to this embodiment is particularly suitable for use with containers formed with a side having other than a fixed radius. This embodiment has many points of similarity to the embodiment shown in FIG. 4 except that the separator elements 33 and 33A are each provided with small tabs 51 defined by semicircular cut lines 52 in the central stem 38. The tabs 51 are adapted to engage a side of the container C along one of the lesser diameters thereof, and below a point where such diameter increases, to prevent the erected partition structure from being dislodged upward from between the containers.

Figure 17:
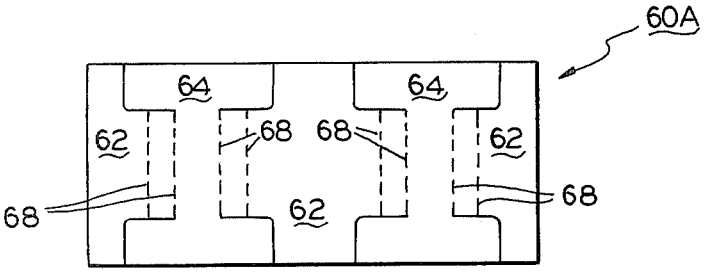
FIG. 17 is a plan view of a cut and scored blank according to a further embodiment of the present invention.
Figure 19:
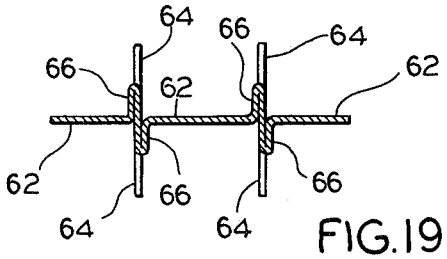
FIG. 19 is a sectional view taken generally along the lines 19—19 of FIG. 18.
Figure 18:
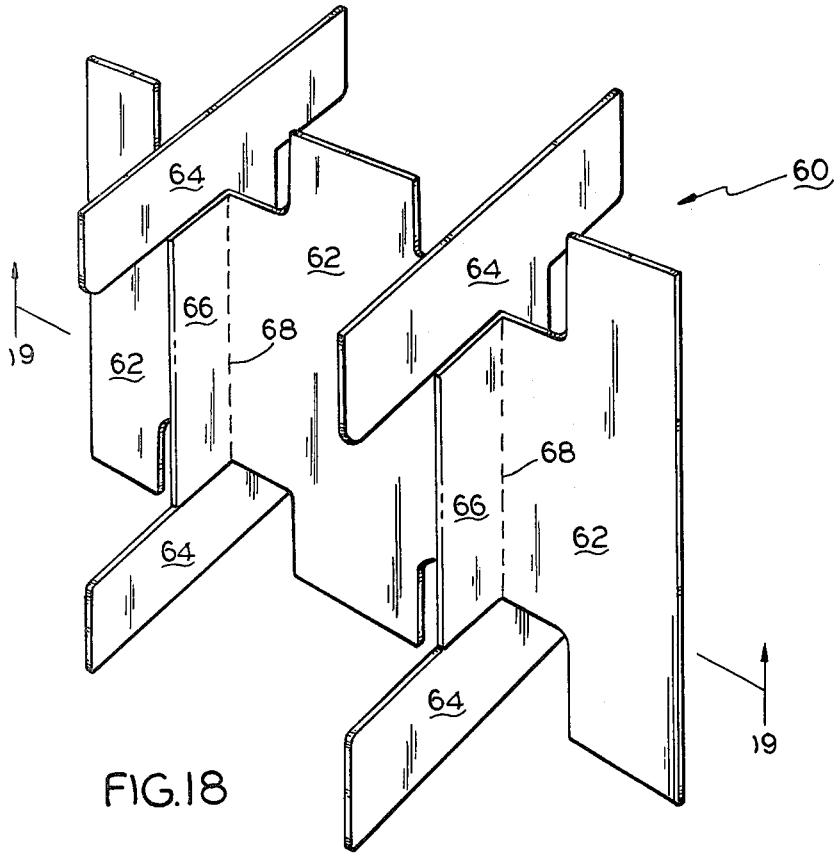
FIG. 18 is a isometric view showing a separator formed from the blank of FIG. 17.

FIGS. 17–19 show a further embodiment 60 of a partition structure formed from a cut and scored blank 60A. The exemplary embodiment illustrated is adapted for separation of six containers but the structure can be easily extended or shortened to accommodate different numbers of containers. Longitudinal separator elements 62 extend between rows of containers and are in parallel alignment with the longitudinal center lines of said rows. Transverse separator elements 64 may be formed in series and are folded from said blank 60A to extend between adjacent containers in each row of the package. The longitudinal separator elements 62 and the transverse elements 64 are foldably linked by intermediate panels 66 folded from the blank 60A along fold lines 68. The presence of the intermediate panels 66 permits placement of the longitudinal separator elements 62 at right angles to the transverse separator elements 64. In other embodiments of this invention, the longitudinal separator elements are inclined with respect to the transverse separator elements.

I claim:

1. A partition separator formed from a cut and scored blank of paperboard or the like for separating rows of containers and adjacent containers in each row, said separator comprising:

(a) a plurality of foldably joined separator elements extending longitudinally between the rows of said containers;

(b) each of said separator elements being in a vertical plane angularly inclined to a vertical plane extending between the rows of said containers;

(c) transversely extending separator elements foldably and angularly joined to said first named separator elements;

(d) each of said transversely extending separator elements extending between adjacent containers of a row thereof and being in a plane angularly disposed relative to said vertical plane of said first named separator elements.

2. A partition separator according to claim 1, wherein each of said first named separator elements is defined by parallel fold lines connected by cut lines.

3. A partition separator according to claim 1, wherein at least one of said transverse partition elements is provided with a foot preventing upward movement of said separator.

4. A partition separator according to claim 1, wherein said transverse partition element has a full length portion and an opposite half length portion and a like partition separator is nested in a reversed vertical position to provide separation of an additional row of containers.

5. A partition separator formed from a cut and scored blank of paperboard or the like for separating rows of containers and adjacent containers in each row, said separator comprising:

(a) at least two first separator elements extending between the rows of said containers;

(b) each of said first separator elements being in a vertical plane angularly inclined to a vertical plane extending between the rows of said containers;

(c) at least one transversely extending separator element foldably and angulary joined to each of said first separator elements;

(d) said transversely extending separator element extending between a pair of side by side containers in each of said separate rows of containers and being in a plane angularly disposed to said vertical plane of said first separator elements.

6. A partition separator according to claim 5, wherein said first separator elements are parallel to one another.

7. A partition separator according to claim 5, wherein said transversely extending separator element is normal to a vertical plane extending between the rows of said containers.

8. A partition separator according to claim 5, wherein at least one of said first separator elements is provided with a foot preventing upward movement of said partition separator.

9. A partition separator formed from a cut and scored blank of paperboard or the like for separating rows of containers and adjacent containers in each row, said separator comprising:

(a) a series of first separator elements angularly extending between the rows of said containers;

(b) each of said first separator elements being in a vertical plane angularly inclined to a vertical plane extending between the rows of said containers;

(c) a series of transversely extending separator elements;

(d) each of said transversely extending separator elements being interposed between a pair of adjacent first separator elements and angularly hinged to said first separator elements along parallel fold lines;

(e) each of said transversely extending separator elements extending between a pair of adjacent containers in each of said separate rows of containers.

10. A partition separator formed from a cut and scored blank of paperboard or the like for separating rows of containers and adjacent containers in each row, said separator comprising:

(a) a chain of hingedly connected separator elements, including a series of angularly disposed longitudinal separator elements and a series of transverse separator elements angularly disposed with respect to said longitudinal element:

(b) said longitudinal separator elements separating said rows of said containers;

(c) said transverse separator elements separating adjacent containers in each row;

(d) said transverse separator elements each being angularly disposed between a pair of adjacent longitudinal separator elements.

* * * * *